US006007403A

United States Patent [19]

Urspringer et al.

[11] Patent Number: 6,007,403

[45] Date of Patent: Dec. 28, 1999

[54] FLEXIBLE CONSTRICTOR FOR INFLATABLE BODIES

[76] Inventors: Steven E. Urspringer, 1894 Roland Ave., Camarillo, Calif. 93010; John R. Urspringer, 4942 Paseo Montelena, Camarillo, Calif. 93012

[21] Appl. No.: 08/972,125

[22] Filed: Nov. 17, 1997

[51] Int. Cl.[6] ..... A63H 3/06; B65D 77/10

[52] U.S. Cl. ..... 446/222; 24/30.5 S

[58] Field of Search ..... 446/222, 220, 446/225; 24/30.5 S, 30.5 R, 562, 3.2; 383/71

[56] References Cited

U.S. PATENT DOCUMENTS

| | | | |
|---|---|---|---|
| 1,098,286 | 5/1914 | Miller . | |
| 1,166,690 | 1/1916 | Kahn . | |
| 1,242,139 | 10/1917 | Callahan | 24/30.5 S |
| 1,350,935 | 8/1920 | Pastor . | |
| 1,467,411 | 9/1923 | Witten . | |
| 1,478,757 | 12/1923 | O'Connor . | |
| 1,543,954 | 6/1925 | Shira | 446/222 |
| 1,986,484 | 1/1935 | Schlueter . | |
| 2,396,906 | 3/1946 | Windson . | |
| 2,457,274 | 12/1948 | Rifkin | 24/562 X |
| 2,460,963 | 2/1949 | Young | 24/30.5 S X |
| 2,844,351 | 7/1958 | Smith . | |
| 3,236,005 | 2/1966 | Tomosy et al. . | |
| 3,366,999 | 2/1968 | Darby . | |
| 3,383,131 | 5/1968 | Rosfelder . | |
| 3,780,419 | 12/1973 | Allison et al. . | |
| 3,820,200 | 6/1974 | Myers | 24/30.5 S |
| 3,962,757 | 6/1976 | Gedney | 24/562 |
| 4,189,808 | 2/1980 | Brown | 383/71 |
| 4,428,149 | 1/1984 | Brown . | |
| 4,570,304 | 2/1986 | Montreuil et al. | 24/30.5 S |
| 4,697,312 | 10/1987 | Freyer | 24/30.5 S |
| 4,914,789 | 4/1990 | Pederson | 24/30.5 S |
| 4,936,532 | 6/1990 | Williams . | |
| 5,628,091 | 5/1997 | Mueller | 446/222 X |

FOREIGN PATENT DOCUMENTS

| | | | |
|---|---|---|---|
| 463302 | 7/1928 | Germany | 446/222 |

*Primary Examiner*—D Neal Muir
*Attorney, Agent, or Firm*—W. D. English

[57] ABSTRACT

A fluid flow prevention device to be used with flexible conduits, and more particularly with toy balloons. The device is made of a resilient material and has a centrally and axially located normally closed slit through which a ring of a balloon's mouth may be inserted when the slit is forced open, whereby a neck of the balloon is maintained within the slit as the slit closes. After inflation of the balloon's body, the body and the ring are rotated in opposite directions, whereby the neck of the balloon is caused to twist. The resilient material of the device maintains closure of the slit whereby the wall defining the slit maintains the neck in its twisted position and prevents egress of fluid. In addition, the contractile force of the twisted neck draw the ring and the body of the balloon into frictional contact with the top and bottom surfaces of the device and further prevents untwisting of the neck and further prevents egress of fluid.

1 Claim, 2 Drawing Sheets

FLEXIBLE CONSTRICTOR FOR INFLATABLE BODIES

FIELD OF THE INVENTION

The invention relates to the art of restricting or preventing fluid flow through flexible conduits, and more particularly to a unitary device designed to conveniently constrict and thereby releasably shut off the air inlet tube of a balloon. Each individual fluid flow prevention device may be connected to others of the same to make ornamental arrangements of attached balloons.

DISCUSSION OF THE PRIOR ART

Toy balloons have served the function of decorations for parties, commercial promotions, and political rallies, as well as for toys, water balloons, and other purposes. Devices and processes for preventing deflation have been attempted through the difficult task of tying the balloon neck itself complex attachment mechanisms, and other apparatus which are susceptible to failure. In addition, the previous mechanisms have been made of heavy material and do not allow helium filled balloons to rise.

U.S. Pat. No. 1,166,690 to Kahn, utilizes two disks with a washer deposited between the two disks. The disks and washers have axial holes through which the mouth and neck of the balloon are inserted. The mouth of the balloon must then be stretched over the top washer, which is a difficult task in itself; in addition, inflating the balloon is made difficult because human lips will have difficulty surrounding the opening and exhaling air under enough pressure to inflate the balloon. After the balloon is inflated the two discs are turned in opposite directions in respect to one another. However, during the twisting procedure deflation will occur because the mouth of the balloon is not covered. Furthermore, Kahn's invention relies solely on the pressure created within the body of the balloon to push against the lower disk to prevent untwisting of the neck. If the balloon is inadequately filled there will be inadequate pressure to maintain the washers in a rigid position and deflation will occur when the neck of the balloon unwinds.

U.S. Pat. No. 1,350,935 to Pastor provides a concave shaped ring with the mouth and the neck of the balloon inserted there through. The mouth of the balloon is stretched and folded over the top of the ring with difficulty, the balloon is inflated, and the body of the balloon is twisted with respect to the ring to close off the neck. The Pastor device is inadequate since during the twisting procedure deflation will occur because the mouth of the balloon will not be covered when the inflating device is detached. Furthermore, the invention relies solely on the pressure created within the body of the balloon to push against the lower portion of the ring to prevent untwisting of the neck; however, if the balloon is inadequately filled, the lack of pressure will cause the invention to fail and deflation will occur.

U.S. Pat. Nos. 1,098,286, and 1,478,757 to Miller and O'Connor respectively, insert a plug with an axial hole and a straw respectively into the mouth of the balloon while a ring shaped apparatus surrounds the neck of the balloon. After inflation of the balloon, the body is twisted with respect to the neck to close off the neck. These devices are inadequate because during the twisting procedure deflation will occur since the mouth of the balloon will not be covered when the inflating device is detached. Furthermore, the inventions rely solely on the pressure created within the body of the balloons to push against the lower portion of the rings to prevent untwisting of the balloon; however, if the balloon is inadequately filled the invention will fail and deflation will occur.

U.S. Pat. No. 3,366,999 to Darby discloses a premolded plastic body form with a plurality of holes through which the mouth and neck of an inflated balloon are inserted, the neck is then extended and inserted into a slot, whereby the stretched neck will prevent deflation. The balloons may deflate while being inserted through the holes and during pulling of the neck to secure the mouth of the balloon in the slot. In addition, the ornamental design is predetermined and premolded and cannot be rearranged as an artist may desire.

All the aforementioned prior art balloon closure devices allow escape of fluids while attempting to secure the balloons; furthermore, they are inadequate in maintaining the balloons in an inflated state. Therefore, there remains a long standing and continuing need for an advance in the art beyond the existing art of balloon closure devices that is reliable, is simpler in both design and use, is more economical and efficient in its construction and use, and can readily be arranged in any ornamental design.

OBJECTS OF THE INVENTION

It is a primary object of the invention to provide a reliable fluid flow prevention device to be used with toy balloons.

Another object of the invention is to provide a simple device to prevent egress of fluids from toy balloons.

Another object of the invention is to provide an inexpensive device for preventing flow of fluids to be used with toy balloons.

A further object of the invention is to provide an economical and efficient method of creating a fluid flow prevention device to be used with toy balloons.

Yet another object of the invention is to provide a fluid flow prevention device which can easily be arranged to create aesthetic and ornamental designs by attaching a plurality of said devices to each other to create any desired form and length.

Another object of the invention is provide a fluid flow prevention device that is made of a light material that will allow the floating of helium filled balloons.

DETAILED DESCRIPTION OF THE PREFERRED EMBODIMENT

The following is a description and an enabling embodiment of the best mode of implementing the concept of the invention. This description is given only to illustrate the general principles of the invention and is not to be interpreted in a limiting sense. The true scope and further extent of the invention can only be ascertained by reading the appended claims.

Figure 1A:
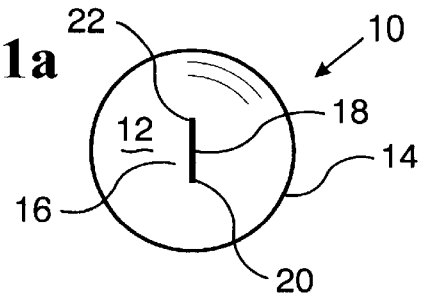
FIG. 1*a* is a top, plan view of the fluid flow prevention device.
Figure 1B:
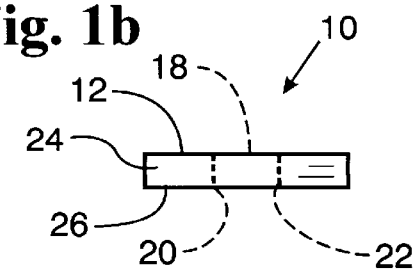
FIG. 1*b* is a side, elevational view of the fluid flow prevention device.
Figure 2:
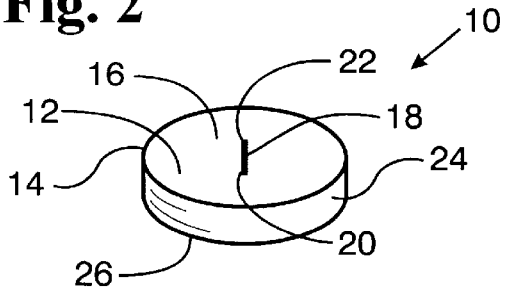
FIG. 2 is a perspective view of the fluid flow prevention device.

Referring now to FIGS. 1*a,* 1*b,* and 2, a fluid flow prevention device 10 to be used with any flexible conduit is shown. Fluid flow prevention device 10 can be made of any non-rigid and resilient material such as, but not limited to, thermo close cell plastic foam cross linked ethyl vinyl acetate (EVA), polyethylene base foam materials, general rubber, or latex. The shape of the material can vary according to aesthetic desires and can be any regular or irregular, symmetrical or non-symmetrical circle, ellipse, or polygon. In the present embodiment a circular, disk shaped fluid flow prevention device 10 is illustrated, wherein said device 10 is cut from a solid sheet of polyethylene material and forms a top surface 12, a bottom surface 26, and a side wall 24 connecting aforesaid surfaces. The thickness of said device 10 should be at least 0.0625 inches, and the diameter of said device 10 can vary, depending upon the size of a conduit to be secured, from 0.25 inches to any necessary size. Top surface 12 has an outer portion 14 and an inner portion 16. An aperture 18 is cut through top surface 12 and extends axially from the top surface 12 through the bottom surface 26. Aperture 18 is in the form of a slit having a top end 22 and a bottom end 20, and said aperture 18 is defined by inner wall 30, as illustrated more clearly in FIG. 3. The length of the aperture 18 can vary in size, and needs to be sufficient enough for the insertion of a conduit such as a balloon stem or neck.

Figure 3:
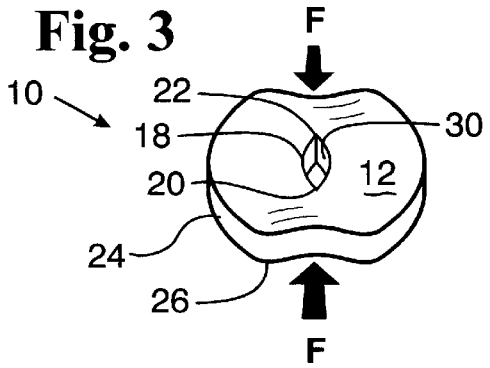
FIG. 3 is a perspective view of the fluid flow prevention device in a compressed position.

Now referring to FIG. 3, by using the forefinger and the thumb pressure "F" is applied to side wall 24 at positions in line with said top end 22 and said bottom end 20, thereby causing aperture 18 to widen and open up.

Figure 4:
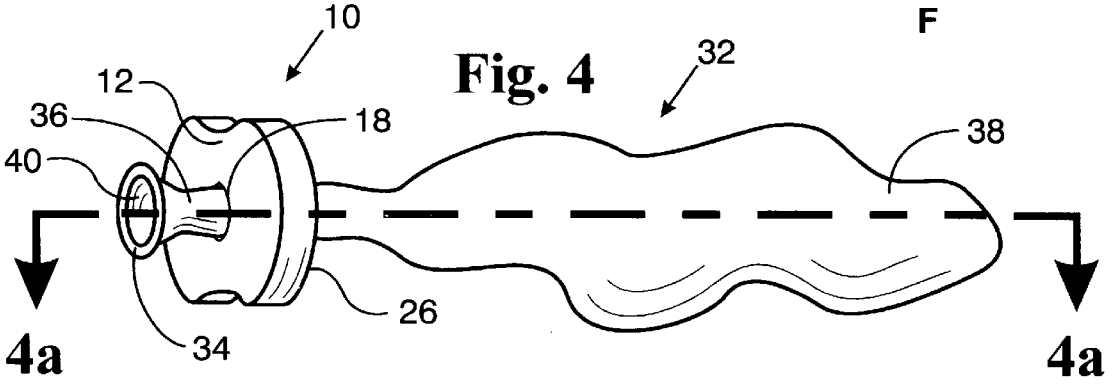
FIG. 4 is a perspective view of invention with a deflated balloon therein.
Figure 4A:
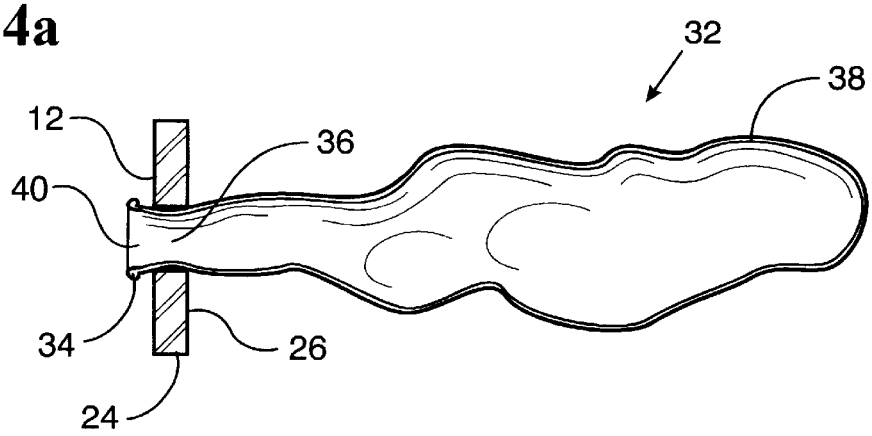
FIG. 4*a* is a cross section of the fluid flow prevention device taken in the plane indicated by line 4*a*—4*a* of FIG. 4 containing a deflated balloon therein.

Now referring to FIGS. 4 and 4*a,* a balloon 32 has a body 38 extending from a neck 36. Neck 36 has an annular ring 34 extending around and defining an opening 40 which is congruous with inner surface of body 38. While said aperture 18 of device 10 is widened, annular ring 34 is compressed and inserted through aperture 18 from bottom surface 26 and exits from said top surface 12; whereby, neck 36 is maintained within aperture 18. The diameter of neck 36 should be sufficiently larger than the width of aperture 18 to prevent withdrawal of neck 36. Fluids, e.g. air, water, or Helium, may now be introduced through opening 40 into body 38 to inflate balloon 32.

Figure 5:
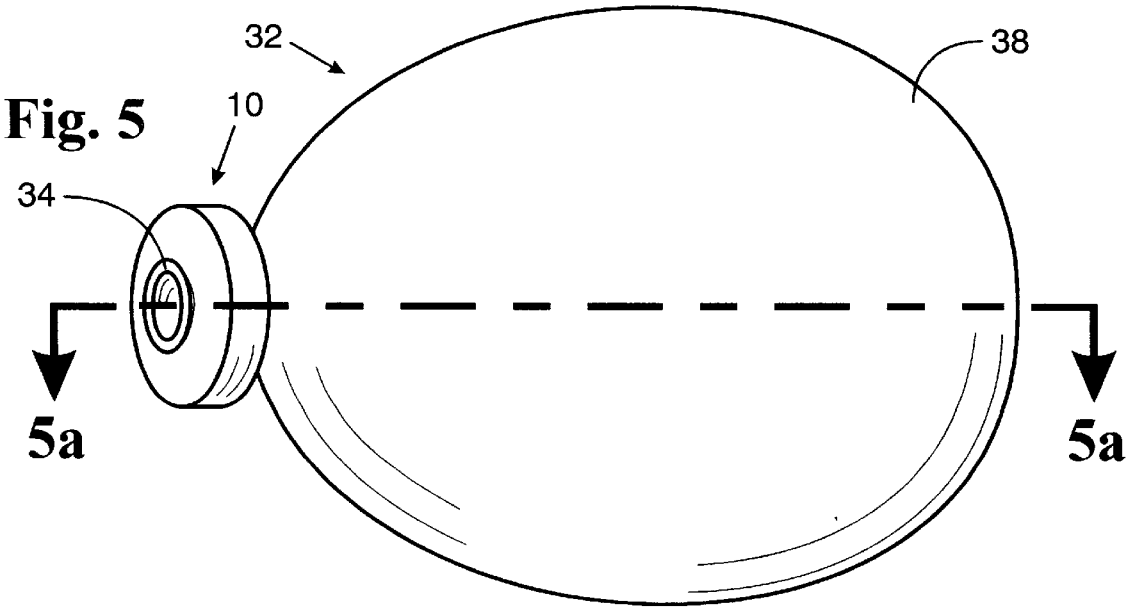
FIG. 5 is a perspective view of invention with a secured, inflated balloon therein.
Figure 5A:
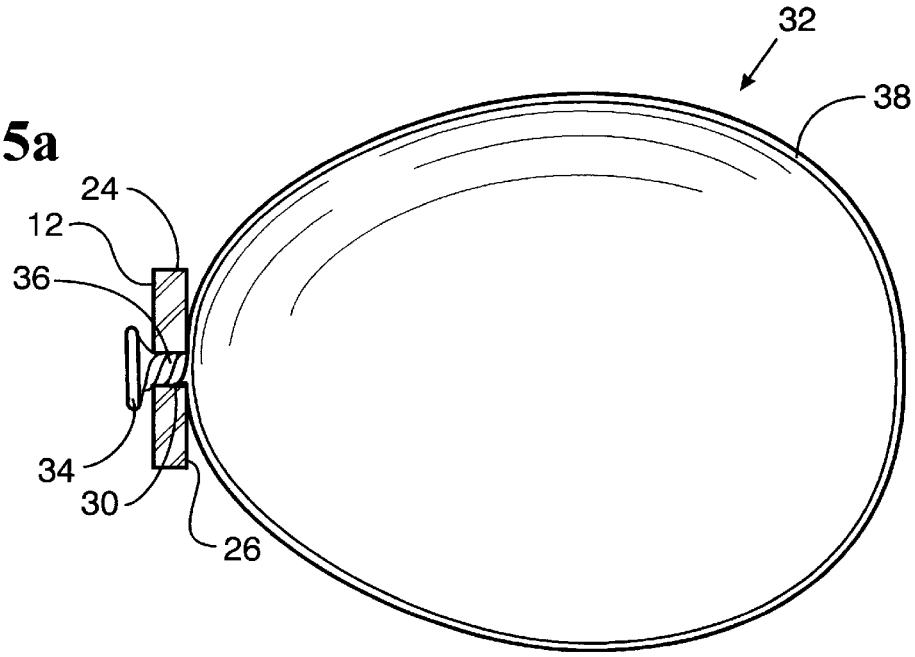
FIG. 5*a* is a cross section of the fluid flow prevention device with an inflated balloon contained therein taken in the plane 5*a*—5*a* of FIG. 5.

Referring now to FIGS. 5 and 5*a,* balloon 32 is demonstrated in an inflated position and secured by the invention 10. After inflation, balloon body 38 is twisted with respect to ring 34. The balloon neck 36 will then assume a twisted state within slot, aperture 18, which effectualy will prevent the escape of the fluid from the balloon body 38. Inner wall 30 of slot 18, as a result of the resilient nature of the material of said device 10, contracts and applies pressure to the twisted neck 36 thus preventing uncoiling thereof. Furthermore, the contracting force created by the twisted neck 36 forces ring 34 into frictional contact with top surface 12 and forces inflated body into frictional contact with bottom surface 26 of device 10, whereby untwisting of neck 36 is prevented. To deflate the body 38, it is necessary to untwist the neck 36, which may be done by turning body 38 with respect to ring 34, or vice versa, which will open neck 36 for the escape of the inflating fluid through opening 40. Fluid flow prevention device 10 is reusable, and the aforementioned instructions may be followed to inflate other balloons and maintain them in an inflated condition.

Figure 6:
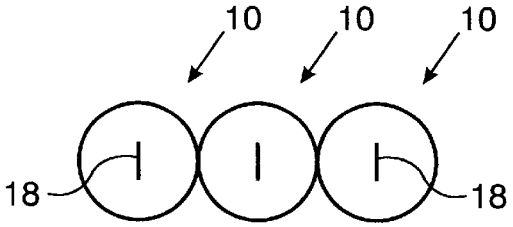
FIG. 6 is a top, plan view of a plurality of conjoined fluid flow prevention devices.
Figure 6A:
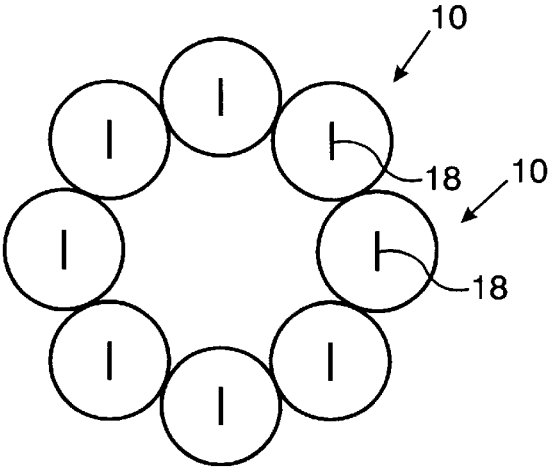
FIG. 6*a* is a top, plan view of an alternate embodiment of a plurality of conjoined fluid flow prevention devices.

FIGS. 6 and 6*a* demonstrate a plurality of interconnected fluid flow prevention devices 10 which are connected to each other through VELCRO® means or any other adhesive means to form a wide variety of ornamental patterns. Balloons 32 are inserted into each individual aperture 18 and inflated, as described above, to form aesthetic designs and various geometrical figures and various polygon shapes.

While the invention herein disclosed has been described by means of a specific embodiment and application thereof, numerous modifications, and variations could be made thereto by those skilled in the art without departing from the spirit and scope of the present invention. Accordingly, the scope of the invention should be determined not by the embodiments illustrated, but by the appended claims and their legal equivalents thereto.

I claim:

1. A method for making and utilizing a spongy, disc shaped closure device for inflatable bodies, comprising the steps of:

forming said device from a spongy, resilient material to produce a relatively thick disc with a top surface, a bottom surface, and an outer wall;

creating an aperture in the manner of a normally closed slit defined by an inner wall extending axially from said top surface through said relatively thick closure device to said bottom surface;

squeezing said outer wall of said closure device on opposing ends of said slit, thereby forcing said closed slit/aperture to open and expose said inner wall;

attaching to said closure device a resilient inflatable body having a neck portion, a body portion extending from said neck portion, and a flexible and resilient ring, defining an opening, attached to said neck portion at an end opposite to that of said body;

inserting said ring through said aperture/slit of said closure device from said top surface and pulling said ring out of said aperture from said bottom surface of said closure device;

inflating said body by again squeezing said outer wall to force open said inner wall thereby allowing introduction of a fluid through said opening of said ring;

introducing a pressurized fluid into said resilient inflatable body to inflate said inflatable body;

rotating said inflated inflatable body in a direction opposite to a concomitant rotation of said closure device thereby causing said neck therein to assume a fixed twisted position by frictional contact with said inner wall of said closure device and said bottom surface with said inflated inflatable body, thereby preventing untwisting of said neck and egress of any fluids from said body.

* * * * *